US005368103A

United States Patent [19]

Heathman et al.

[11] Patent Number: 5,368,103

[45] Date of Patent: Nov. 29, 1994

[54] METHOD OF SETTING A BALANCED CEMENT PLUG IN A BOREHOLE

[75] Inventors: James F. Heathman, Duncan, Okla.; Robert B. Carpenter, Allen, Tex.; Anthony M. Badalamenti, New Orleans, La.; Kenneth P. Marcel; Robert R. Siffert, both of Lafayette, La.; Charles J. Rimer, Plano, Tex.

[73] Assignee: Halliburton Company, Duncan, Okla.

[21] Appl. No.: 127,840

[22] Filed: Sep. 28, 1993

[51] Int. Cl.[5] ..... E21B 33/134; E21B 21/00

[52] U.S. Cl. ..... 166/289; 166/290; 166/312

[58] Field of Search ..... 166/285, 286, 289, 290, 166/311, 312, 222

[56] References Cited

U.S. PATENT DOCUMENTS

| | | | |
|---|---|---|---|
| 2,811,206 | 10/1957 | Klotz | 166/285 |
| 3,052,298 | 9/1962 | Malott | 166/312 X |
| 3,289,760 | 12/1966 | Kammerer | 166/290 |
| 3,391,737 | 7/1968 | Havens | 166/289 |
| 3,777,819 | 12/1973 | Delano | 166/285 |
| 4,441,556 | 4/1984 | Powers et al. | 166/290 |
| 5,086,850 | 2/1992 | Harris et al. | 166/290 X |

OTHER PUBLICATIONS

"Improved Method of Setting Successful Cement Plug", *Journal of Petroleum Technology,* 1984, R. C. Smith, et al., pp. 1897–1904.

Technical Paper SPE 15008, "Development of Effective Methods for Placing Competent Cement Plugs", 1986, By D. L. Bour, et al.

*Primary Examiner*—George A. Suchfield

*Attorney, Agent, or Firm*—Robert A. Kent

[57] ABSTRACT

A method of forming a kickoff plug in a borehole is disclosed. The method includes a first phase in which the interval to be cemented is treated to remove gelled mud and mud cake from the walls of the borehole and in which drilling fluid is conditioned for subsequent cementing operations. The method includes a second phase in which a hydrostatically balanced plug of a hydraulic cement slurry is placed in the interval to be cemented and then permitted to harden to form the kickoff plug. Each phase of the method features the injection of high velocity streams of fluid, e.g. drilling fluid and cement slurry, into the borehole in a plane or planes which are substantially parallel to the cross section of the borehole and at linear velocities sufficient to cause circulation of gelled mud, mud cake, and drilling cutting from the borehole.

20 Claims, 2 Drawing Sheets

CLEANOUT PHASE

CLEANOUT PHASE

CEMENTING PHASE

FLUID FLOW PATTERN AND CONDUIT CROSS-SECTION AT INJECTION LOCATION

METHOD OF SETTING A BALANCED CEMENT PLUG IN A BOREHOLE

BACKGROUND OF THE INVENTION

1. Field of the Invention

This invention pertains to methods of conducting cementing operations in boreholes which penetrate subterranean earth formations. This invention still further pertains to a method of placing a balanced cement plug in a borehole.

2. Problems Solved

When drilling a borehole which penetrates one or more subterranean earth formations, it has, at times, been and continues to be, either advantageous or necessary to change the direction of the borehole as it is being drilled. In order to held in the change of direction, it has sometimes been a practice by those skilled in the art to place in the borehole, in the vicinity of the location therein where the change in drilling direction is to begin, a hardened mass of a hydraulic cement composition. This hardened mass of hydraulic cement is referred to in the art, and herein, as a sidetrack plug or as a kickoff plug or simply as a plug.

The specific function of a kickoff plug is to cause the drill bit to divert its direction. Accordingly, if the plug is harder than the adjacent formation, then the drill bit will tend to penetrate the formation rather than the plug and thereby produce a change in drilling direction. It should be noted that specific directional tools are also involved in drill direction changes, but such tools are not within the scope of this invention and will not be discussed.

A kickoff plug may fail to cause the drill bit to change direction if the plug is unreasonably contaminated with a foreign material, such as drilling mud, because drilling mud, when mixed in the set cement, can render the set mass softer than the adjacent formation. Accordingly, a problem encountered in all cementing operations is to remove foreign material, such as drilling mud, from the portion of the borehole to be cemented so as to avoid mixing drilling mud with the slurry of hydraulic cement and water. Thus, an object of this invention is to place in the desired location a competent plug of set cement. For purposes of this disclosure, a competent cement is a water slurry of hydraulic cement which does not promote solids separation, which is not contaminated with drilling fluid or any natural well fluid, such as formation water, gas or liquid hydrocarbon and which does not contain free water. A competent cement slurry, upon setting, will produce a homogenous mass of hardened cement.

Another object of this invention is to provide a method of introducing a slurry of hydraulic cement in water into the location of the borehole to be cemented in a manner which will avoid, or at least minimize, any mixing of the cement slurry with drilling mud present in the borehole while the drilling mud is being displaced therefrom by the cement slurry.

A kickoff plug may also fail to cause the drill bit to change direction, even if a homogeneous mass of cement is placed as desired, if the plug is not in sufficient contact with the wall of the borehole. Absence of sufficient contact between the set cement plug and the borehole wall can permit the plug to move (horizontally or vertically) or to rotate—and thus fail to resist the impact of the drill bit. Absence of sufficient wall contact, as mentioned above, can be caused by the existence of a layer of viscous drilling fluid or drilling solids, referred to herein as gelled mud or mud cake, respectively, between the sides of the plug and the wall of the borehole. It will be appreciated, that the existence of gelled mud or mud cake, as described above, has the effect of reducing the cross-section of the kickoff plug to a value less than the cross-section of the borehole. It is thus another object of this invention to provide a method of substantially removing gelled mud or mud cake from the walls of the borehole in the portion of the hole to be cemented so as to produce a plug having a cross section substantially the same as the cross section of the borehole.

For purposes of more specific definition, mud cake, as used herein, means a solid material, which adheres to the walls of a borehole, consisting of the solids content of a drilling fluid that has experienced the loss of all or of substantially all liquid initially used to carry or suspend the solids in the drilling fluid. It is thought, for example, that as a drilling fluid is pressed against the walls of a borehole the liquid is squeezed therefrom resulting in a cake of solids which adhere to the wall of the borehole.

Gelled mud, which is sometimes referred to as immobile mud, as used herein, means a drilling fluid that has developed, for various reasons, a gel strength, which is so high that the amount of energy required to move it is much greater than the amount of energy required to move drilling fluid which has a relatively much lower gel strength. For purposes of comparison, drilling fluid has a gel strength in the range of from about 0 to about 100 pounds per 100 square feet, whereas gelled mud has a gel strength greater than the drilling fluid being used.

As used herein, the terms drilling fluid and drilling mud have the same meaning and are used interchangeably. Gelled mud and mud cake, while being derived from drilling fluid, are not drilling fluid and have the meanings as above defined.

Known methods of producing kickoff plugs have traditionally produced plugs which have failed to successfully divert the drill bit to a new direction. It is not uncommon in the industry to produce two to four plugs before a successful diversion can be achieved. In some cases, as many as twelve kickoff plugs have been produced before a successful diversion has been achieved.

It is believed that the methods of forming the cement plug as disclosed herein will, if followed, produce a kickoff plug which will not fail to produce a successful drilling diversion and thus will eliminate the practice of forming multiple plugs in order to achieve a successful diversion of drilling direction. This invention thus solves the problems referred to above and satisfies a long felt, but, heretofore, unsolved need.

DISCLOSURE OF THE INVENTION

Figure 1:
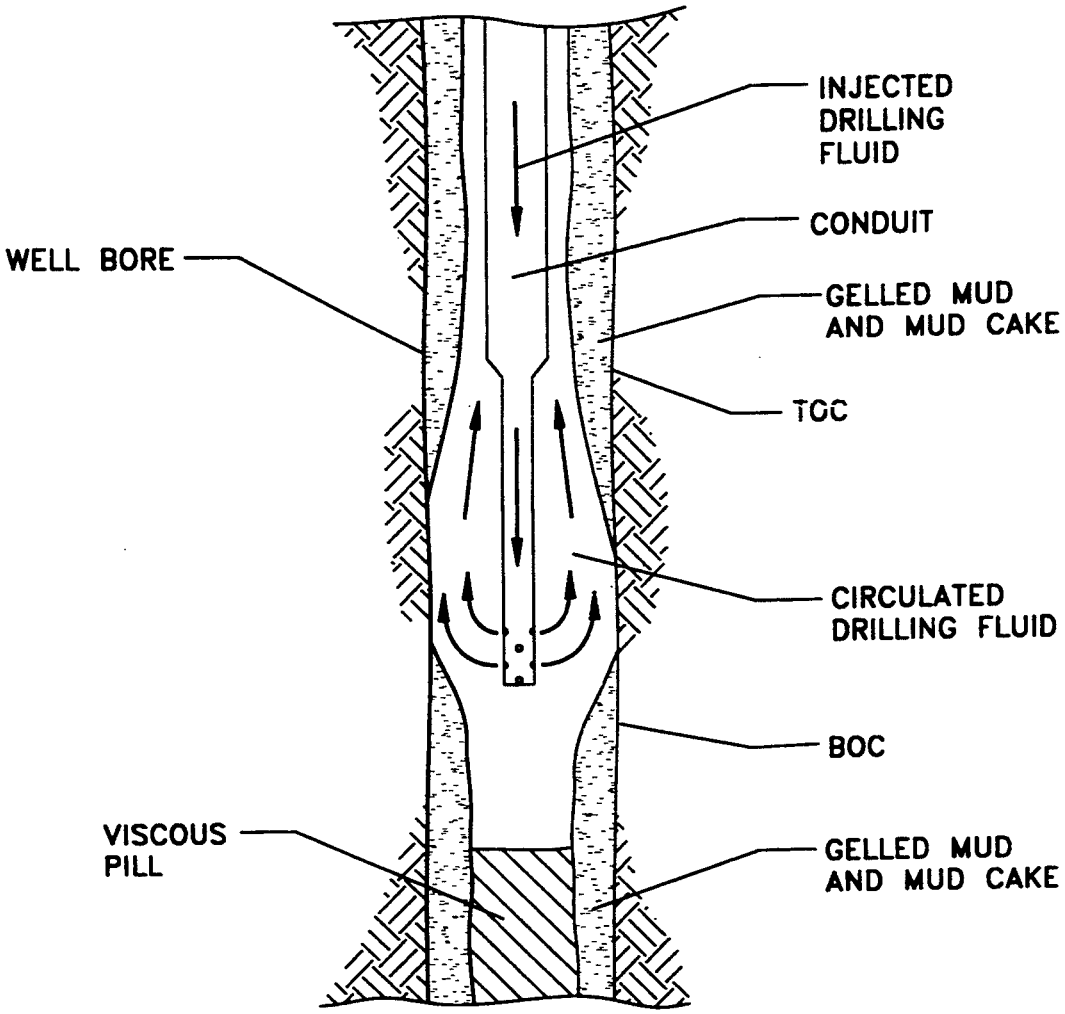
FIGS. 1, 2 and 3 provide a schematic pictorial illustration of the method of the present invention.

Thus, according to this invention, there is provided a method of conditioning a borehole for cementing which specifically features removing gelled mud and mud cake from the walls of the borehole. This invention also provides a method of introducing a water slurry of a hydraulic cement into a borehole in a manner which will prevent, or at least minimize, any mixing of the slurry with the contents of the borehole so that, upon setting, a homogenous mass of hardened cement will be produced.

The above referred to methods of this invention are very advantageously combined to produce a kickoff plug; thus this invention also provides a method of placing a kickoff plug in a borehole.

According to the method of this invention for placing a kickoff plug in a borehole, the method begins at a time after a borehole has been drilled to the desired depth; the drill string has been removed from the borehole; the borehole is filled with drilling fluid; and the location in the borehole where the top of the plug is to be positioned is established. A borehole in the context of this invention may be cased, uncased or include both cased and uncased portions. For purposes of this invention, the location of the top of the plug is referred to as "top of cement" or simply as TOC. Thereafter, by well known means, the volume of cement slurry required to be used to form the plug is determined, the length of the cement plug and therefore the length of the cemented interval is determined and the location of the bottom of the plug is determined. For convenience, the bottom of the plug is referred to as "bottom of cement" or simply as BOC.

The first phase of the method of this invention is to condition the borehole for placing cement in the portion thereof between TOC and BOC.

Accordingly, introduce a conduit into the borehole wherein the conduit is adapted to permit injection of fluid into the borehole from the sides of the conduit at or near the bottom thereof; position the bottom of the conduit at the desired TOC.

When the bottom of the conduit reaches TOC, drilling fluid is then injected into the borehole from the bottom of the conduit by way of openings in the sidewalls thereof. At least two streams of drilling fluid are injected into the borehole at high velocity wherein the streams of drilling fluid are injected in a plane, or planes, which are substantially parallel to the cross section of the borehole. For purposes of this invention, the term "high velocity", when used in connection with the drilling fluid injected into the borehole from the conduit, means a linear velocity greater than the linear velocity of the drilling fluid as it moves in the conduit from the top of the borehole and also greater than the linear velocity of the drilling fluid as it moves in the annulus between the borehole and the conduit to the top of the borehole. Once injection of drilling fluid is started it is continued and circulation is established whereby drilling fluid is removed from the annular space between the conduit and the borehole at the top of the borehole. The drilling fluid removed is stored and processed at the surface where it is treated to remove foreign matter such as drill cuttings, gelled mud, mud cake and entrained gas; the density and viscosity of the drilling fluid are adjusted to desired values by well known means and the drilling fluid, as treated, is then pumped into the conduit, also known as the cementing string or work string, to continue circulation. At this point in the method, the entire conduit is filled with drilling fluid; the annulus is filled with drilling fluid and circulation of drilling fluid is established.

The method of injecting the drilling fluid from the conduit into the borehole during the conditioning phase is an important feature of this invention. It has been the practice in the prior art to circulate drilling fluid by injecting it from the end of the conduit in a substantially downward direction at the bottom of the conduit. By the prior art method, the injected fluid is therefor required to completely reverse its direction of flow to enable circulation. This reversal of flow direction of the injected fluid consumes energy and therefore diminishes the ability of the injected fluid to establish movement of gelled mud and mud cake.

By the method of this invention, as previously disclosed, the injected fluid exits by way of openings in the wall of the conduit at the bottom thereof in at least two streams which do not move in a downward direction. Accordingly, the streams do not consume energy required to reverse flow direction. The injected streams exit the conduit in planes parallel to the cross section of the borehole or in an upward direction. Furthermore, the linear velocity of the injected streams is not only sufficient to establish circulation, but is also sufficient to impinge the walls of the wellbore with a force sufficient to promote movement of gelled mud and mud cake from the walls of the borehole and to circulate the gelled mud and mud cake to enable removal thereof from the drilling fluid at the surface (as previously mentioned). Still further, the injected streams can impact the walls of the borehole in the plane or planes, as described above, along a radius of the borehole, (i.e., perpendicular to the wall), but it is preferred that the movement of the injected streams not be along a radius of the borehole but rather at an acute angle to the wall, whereby a swirling action is created.

In order to form the high velocity streams of injected drilling fluid, as above described, the circulation pumping rate, i.e. the volumetric flow rate, must be established at a high value. Of course, the upper limit of the pumping rate is that which will not produce a pressure which would damage the injection conduit, any casing in the well, or which would fracture a subterranean formation. Furthermore, for purposes of this invention, the circulation pumping rate must produce a linear flow rate in the annulus sufficient to transport dislodged gelled mud and mud cake, drilling fluid and any other foreign matter to the top of the wellbore for treatment as referred to above. It is believed that such a sufficient linear flow rate in the annulus is a velocity in the range of from about 40 to about 300 and preferably in the range of from about 120 to about 250 feet per minute. It is believed that a circulation rate sufficient to produce the desired linear flow rate in the annulus for most uses is a rate in the range of from about 3 to about 25 barrels per minute.

After circulation and pumping rate is established and maintained, the conduit is then lowered, as illustrated in FIG. 1, from TOC toward the bottom of the borehole by a distance which is at least equal to the length of the cemented interval. In some instances the bottom of the conduit is lowered to BOC; in another aspect of the invention involving the use of a viscous pill, the bottom of the conduit is lowered to the predetermined location of the bottom of the viscous pill which, if used, is below BOC. During this phase of the method, the object is to remove gelled mud and mud cake from the walls of the borehole as well as from the borehole itself. The removal can be improved by slowly rotating and/or reciprocating the conduit during the lowering operation. It is emphasized that circulation at the established pumping rate is continued during the entire time that the conduit is being lowered. It is believed that gelled mud and mud cake are readily dislodged and placed in circulation for ultimate removal if circulation is started at TOC while injecting high velocity streams of drilling fluid from the wall of the conduit in accordance with the method of this invention.

When the bottom of the conduit reaches the desired location, the lowering of the conduit is terminated, but circulation, as described above, is continued until at least one, but preferably two, borehole volumes of drilling fluid have been circulated from the bottom of the conduit to the surface. Circulation from the bottom of the conduit is referred to as "bottom-up" in the drilling art. While circulation is proceeding the physical properties and solids content of the drilling fluid are periodically tested. When the tests indicate that the drilling fluid is considered desirable for cementing operations, circulation is terminated provided that the said minimum "bottom-up" circulation has been completed. At this point in time, the first phase of the method of this invention is complete, because, the interval of the borehole to be cemented has been conditioned, that is, the interval has been treated to remove gelled mud and mud cake from the walls of the interval and the drilling fluid is in a condition to commence cementing operations.

The conditioning method of this invention, as described above, is specifically different from the conditioning method of the prior practice in at least two particulars. One of the differences resides in the method of injecting drilling fluid from the wall of the conduit as opposed to injecting from the end thereof. A second difference resides in the initiation of circulation at TOC and proceeding down from that point and then achieving "bottom-up" circulation as opposed to initiating circulation at BOC or lower without conduit movement and then achieving "bottom-up" circulation.

Figure 2:
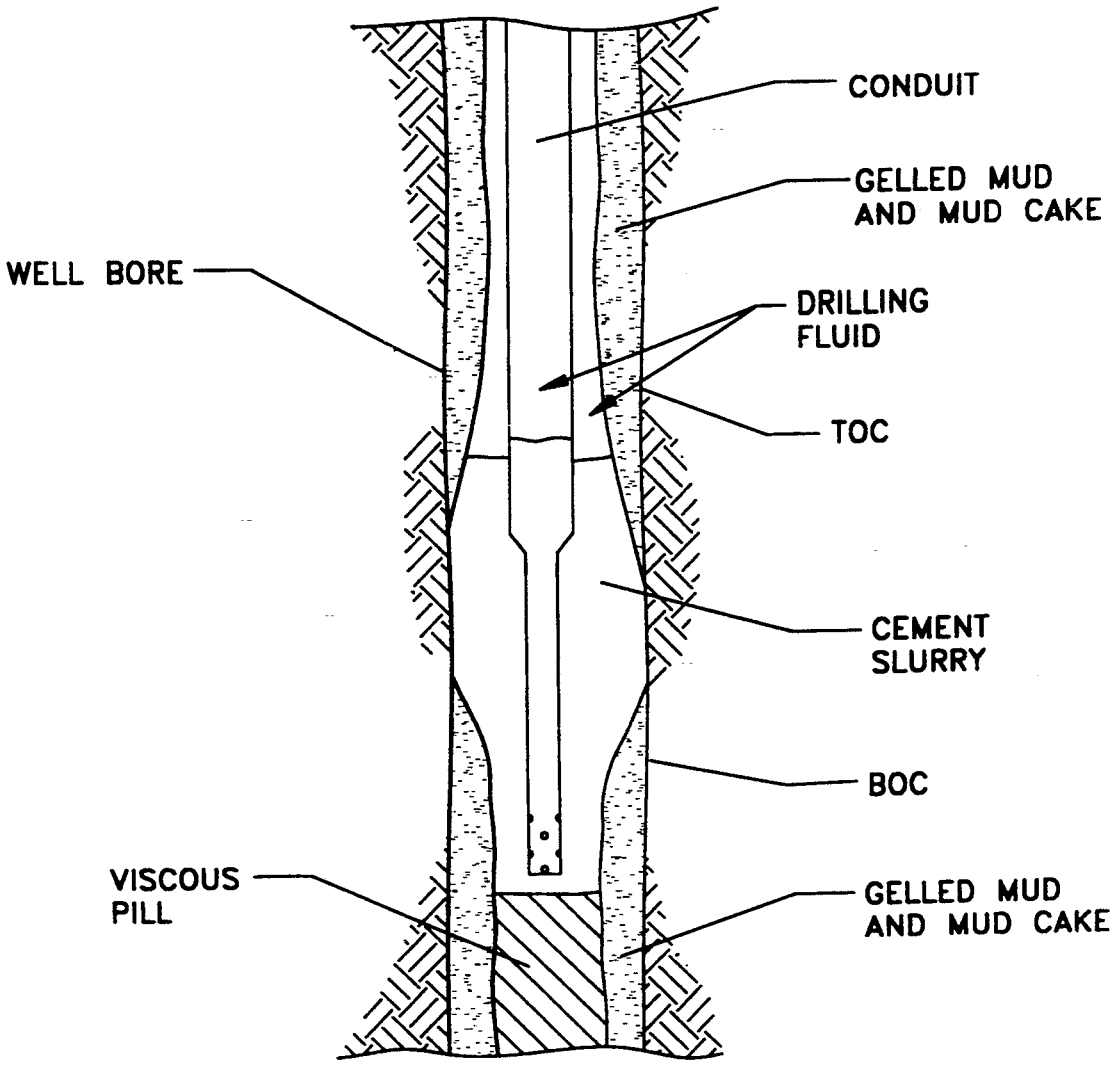

The second phase of the method of this invention, as illustrated in FIG. 2, is to place a water slurry of hydraulic cement in the interval to be cemented in a manner which will prevent, or at least minimize, any mixing of the slurry with the contents of the borehole.

In one aspect of the second phase a "viscous pill" is placed in the borehole below BOC prior to placement of the slurry. In another aspect of the second phase a "viscous pill" is not placed in the borehole, but the slurry is placed at BOC.

The method of placing a viscous pill is the same as the method described below for placing the slurry of cement. Therefore, the method will not be described at this point of the disclosure.

The function of a viscous pill is to resist the tendency of the subsequently placed set plug to move in a downward direction.

If a viscous pill is desired, then, by well known means, the volume of viscous pill required is determined, the length of the pill is calculated and the bottom of the viscous pill is, therefore, that calculated length of viscous pill below BOC. In common practice, the length of the viscous pill is taken to be equal to the length of the cement plug. For purposes of this disclosure, the predetermined bottom of the viscous pill is referred to as pill depth. Accordingly, if a viscous pill is to be placed, then the first phase of the method of this invention, the borehole conditioning phase, is conducted from TOC to pill depth.

Upon completion of the placement of the viscous pill, by the method described below, the bottom of the conduit will be at BOC and then at least one "bottom-up" circulation of drilling fluid is conducted to prepare the drilling fluid for cementing.

The term "viscous pill" is a term employed in the art of borehole drilling and cementing to indicate a fluid having a high internal resistance to movement, but has low or no compressive strength. A fluid having a high internal resistance to movement is said to have a high gel strength and/or a high viscosity. For purposes of this disclosure a fluid having a "high" viscosity has a viscosity of at least about 2 times the viscosity of the drilling fluid.

In practice, a viscous pill, as used in this invention, can be a portion of the drilling fluid which has been treated by, for example, mixing therewith a quantity of clay, such as bentonite, greater than the amount originally employed in the drilling fluid to thereby increase the viscosity of that portion of the drilling fluid. It will be understood that the viscous pill can also consist of specially prepared polymer compositions as is well known in the art.

The method of placing the predetermined quantity of cement slurry (and viscous pill) involves the performance of a technique referred to in the art as placing a "balanced plug". When a balanced plug is placed—that is when all ingredients to be employed have been introduced into the borehole and circulation has terminated—the hydrostatic pressure exerted by the ingredients inside the conduit at its bottom end is equal to the hydrostatic pressure exerted by the ingredients in the annulus at the level of the bottom of the conduit.

For example, when a "balanced plug" is in place the cement slurry will be at the level of BOC and TOC both inside the conduit and in the annulus, any material, such as a spacer or a flush, employed to separate the cement slurry from the drilling fluid extends above TOC for the same distance both inside the conduit and in the annulus, and drilling fluid extends above the spacer material for the same distance both inside the conduit and in the annulus. Ordinarily the columns of drilling fluid extend substantially to the ground surface at the upper end of the borehole.

A specific method for setting a balanced plug is described as follows.

Introduce a volume of spacer fluid compatible with the drilling mud and cement slurry into the cementing string, pump the predetermined quantity of cement behind the spacer fluid, pump a volume of spacer fluid behind the cement and then pump drilling mud behind the spacer fluid while recovering drilling fluid at the wellhead. The pump rate should be adjusted to produce high velocity streams of cement entering the borehole in the manner as described above. Terminate circulation when the level of cement in the cement string and the level of cement in the annulus are the same to thereby produce a hydrostatically balanced plug, whereby the hydrostatic pressure in the annulus and the hydrostatic pressure in the cement string at the location corresponding to the bottom of the plug are the same.

At this point in the performance of the second phase of the method of this invention, circulation has terminated, the balanced plug is in place, and the conduit is in the borehole with its bottom end at BOC. Therefore, withdraw the conduit from the borehole to permit the entire volume of cement slurry inside the conduit to flow out of the bottom of the conduit and into the borehole by way of the openings in the sidewall thereof, as mentioned above, to thereby enable contact between the cement slurry present in the annulus with the slurry present in the conduit.

The rate at which the conduit is removed from the borehole—at least between BOC and TOC—to thus permit the flow of slurry from the conduit into the borehole is a critical feature of this invention. The rate at which the conduit is withdrawn is that rate which will not disturb the hydrostatic balance which was initially established upon placement of the balanced plug and which will not cause, or which will at least minimize, any mixing between the cement slurry and drilling fluid. The rate of conduit withdrawal to meet the above criteria is much lower than the rate of withdrawal presently employed in the known practice.

A specific method for withdrawing the conduit is described as follows.

Withdraw the cementing string from the borehole at a rate which is the smaller of the rate at which the cement in the annulus and string flow into the volume created by the string as it is withdrawn from the hole or at a rate which will minimize any mixing of cement and spacer/drilling fluid which may be caused by the vertical movement of the pipe. Terminate the described controlled withdrawal of the cement string when the string is above TOC at which time the conduit shall have been removed from contact with cement.

Once the bottom of the conduit is above TOC the conduit can be withdrawn at rates ordinarily employed.

The slurry in the borehole subsequent to removal of the conduit, is then permitted to set to thereby produce the homogeneous mass of hardened cement sought to be formed by the method of this invention.

DESCRIPTION OF PREFERRED EMBODIMENTS

It was disclosed above that streams of drilling fluid (and cement slurry) are introduced into the annulus from at least two locations in the wall of the conduit in the vicinity of the bottom of the conduit, wherein the high velocity streams flow in a plane or planes which are substantially parallel to the cross section of the borehole. It was also disclosed that the linear velocity of the streams is a function of the total volumetric flow rate—the circulation rate—of the drilling fluid. It will be understood that stream velocity is also related to the number of streams and the cross section available for individual stream flow.

Figure 3:
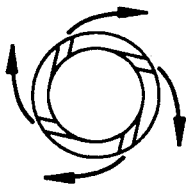

In one preferred embodiment, a total of eight high velocity streams are injected in two spaced apart planes which are each substantially parallel to the cross section of the borehole. Four streams flow in each plane at substantially 90° spacing between each stream in each plane and all streams are caused to flow in the same rotational direction to thereby establish a swirling motion in the circulating drilling fluid, as illustrated in FIG. 3.

In another preferred embodiment, the streams in one plane are offset from the adjacent streams in the second plane by about 45°. The offset is provided to increase the surface area of the borehole contacted by the high velocity streams. The separation between each plane is in the range of from about 0.5 feet to about 2 feet.

The preferred stream flow described above can be conveniently produced by use of a device, referred to herein as a diverter tool, which is attached to the bottom end of the conduit. The diverter tool comprises a short length of conduit having a circular cross-section and having eight holes drilled in the wall thereof. The tool is closed at the bottom end with the top end being open and connectable to the bottom of the conduit. The diverter tool, as mentioned, can be a relatively short tube of circular cross section having two parallel tiers of holes drilled completely through the wall of the tube whereby the exterior and interior of the tube are in communication via the drilled holes. Each tier of holes lies in a plane parallel to the circular cross section of the tool wherein each tier contains four holes. The four holes in each tier are drilled 90° apart, are at least offset from the radius of the tube and are preferably drilled tangentially to the inside surface of the tube wall. Opposite tangential holes in each tier are parallel and in 180° opposed direction. Adjacent tangential holes in each tier emerge from the interior of the tube in directions 90° apart. It will be understood from the above description that four streams of fluid emerging from the interior of the tube via the tangential holes in each tier will move substantially tangentially to the inside surface of the tube wall and, if the streams enter a space, such as an annulus of circular cross section, they will act to establish a swirling motion in the annulus. For purposes of this invention, such tangential flow is referred to as "tangential injection".

The holes in each tier are offset from the holes in the adjacent tier by an amount of about 45° but the holes in both tiers are drilled so that the rotational or swirling motion established by the injected streams from each tier are complimentary and not in opposition. For purposes of this invention the tangential flow established by parallel tiers of holes as above described is referred to as "45° phased tangential injection".

It was mentioned earlier that the linear velocity of fluid (drilling fluid or cement slurry) injected into the borehole from the conduit via each hole in the wall of the conduit is greater than the linear velocity of fluid moving in the conduit. This limitation can be satisfied by limiting the sum of the cross sectional areas of all the holes to a value less than the cross sectional area of the interior of the conduit wherein the linear velocity of fluid flowing through the hole having the largest diameter is greater than the linear velocity of the fluid flowing in the conduit. The limitation can be more conveniently satisfied by dividing the cross sectional area of the interior of the conduit by the cross sectional area of a single hole having a suitable diameter and then limiting the total number of holes, each having that same diameter, to the whole number result of the division without rounding. By this technique, the linear velocity through each hole is equal to the linear velocity through every other hole.

It is a practice in the cementing art that the diameter of a hole in a conduit though which a fluid having solids suspended therein must flow, is in the range of at least about 3 to 5 times greater than the diameter of the largest particle expected to pass through the hole. In the practice of this invention, fluid injection holes in the diverter tool having a diameter of about 0.5 inches have been employed without being plugged by solids suspended in the injected fluid.

The cement slurries useful herein are comprised of hydraulic cement and sufficient water to form a pumpable slurry. The cement slurry may also include additives to combat or otherwise prevent fluid loss and gas migration and to resist loss in compressive strength caused by high downhole temperatures.

Various hydraulic cements can be utilized for forming the cement slurries useful herein. Portland Cement is preferred and can be, for example, one or more of the various Portland Cements identified as API Classes A through H and J Cements. These cements are identified and defined in the *specification for Materials and Testing for Well Cements,* API Specification 10, of the American Petroleum Institute which is incorporated herein by reference. Premium cements which do not meet the exact specifications for the above mentioned API Classes are also suitable for use in accordance with this invention. Of the various hydraulic cements which can be utilized, API Classes G and H and premium cements are preferred.

The water used for forming the compositions can be fresh water or a salt containing water such as oil field brine, seawater or other saturated or unsaturated salt water. The water is generally included in the cement slurry in an amount of from about 30 percent to about 60 percent by weight of the dry hydraulic cement utilized. However, as will be understood, the particular quantity of water utilized can vary appreciably from the aforesaid amounts.

In view of an object of this invention of forming a kickoff plug from a competent cement slurry as defined above there are several aspects of the slurry which require discussion.

The slurry should be stable upon being placed and should therefore exhibit no, or substantially no, free water and should not experience settlement of solids. Free water and solids settling foster component separation which results in a set cement which is not homogeneous. Avoidance of free water and solids settling can be effected by providing adequate gel strength to the slurry. Gel strength is a function of the water and solids content of the slurry and the concentration of various additives known in the art such as set retarders, fluid loss additives and polymers.

However, while slurry gel strength must be high enough to combat separation of water and solids, the slurry gel strength must be low enough to avoid undue interference with the proper placement of the slurry in the borehole. In this regard, recall that after the balanced plug is set, the conduit is pulled out of the borehole at a rate which will not disturb the established hydrostatic balance and which will not promote intermixing of the slurry and foreign material such as drilling fluid. Since an effect of slurry gel strength is to resist flow, any excessive gel strength development in a slurry will cause the slurry to resist flowing from the conduit and annulus as the conduit is withdrawn from the hole. To maintain hydrostatic balance, the slurry must flow to and fill the volume occupied by conduit at the same rate as the volume is created by the withdrawal of the conduit. A slurry having an excessively high gel strength can therefor be a source of lost balance which would cause intermixing of slurry and drilling fluid because it will not flow at a sufficiently high rate. Furthermore, a cement slurry having an excessively high gel strength will manifest resistance to flow by sticking to the outside of the pipe as the pipe is withdrawn thus producing a volume to be occupied by, for example, drilling fluid. In view of the above comments a slurry useful herein has a gel strength in the range of from about 10 to about 80 and preferably in the range of from about 15 to about 40 pounds per 100 square feet.

In addition to the slurry characteristics mentioned above, a cement slurry useful herein should preferably have a density which is not greater than about 0.5 pounds per gallon more than the density of the drilling mud unless there are overriding considerations involving compressive strength requirements which may dictate a cement having a density greater than 0.5 pounds per gallon more than the density of the drilling mud. The reason that the density of the cement slurry is preferably no more than about 0.5 pounds per gallon more than the density of the drilling mud is because greater differences in density can cause movement and thus intermixing of the placed slurry with respect to the drilling fluid when the drilling fluid is below the slurry.

As was stated previously, the gel strength of the drilling fluid is in the range of from about 0 to about 100 pounds per 100 square feet.

The cement slurry employed should not begin to set until it can be fully positioned in the desired portion of the borehole which means that the slurry must be placed in the annulus, and the conduit fully withdrawn to TOC prior to the time that the slurry begins to set. This characteristic is known as thickening time. Accordingly, the thickening time of the cement slurry used herein is equal to placement time plus an additional time in the range of from about 0.5 to 1 hour based on expected circulating temperature in the cemented interval.

After placement, the cement is permitted to set undisturbed for a period of time before operations in the wellbore are presumed. It is preferred that drilling fluid in the borehole above the plug not be reversed out because such reversal may disturb the setting cement. The time spent before further operations can proceed is known in the art as waiting on cement. In this invention, it is preferred that the waiting on cement time for slurries useful herein is at least about 4 hours for each hour of thickening time or 24 hours whichever is more.

It is preferred that cement slurries used in this invention for making kickoff plugs do not contain dispersants and do not contain weighting materials unless such ingredients are required in view of well conditions or cement characteristics. The reasons for the above are as follows. Weighting materials, because of high specific gravity, and dispersants by their nature, can promote solids settling and free water separation.

In addition, slurries used herein to make kickoff plugs preferably contain a minimum amount of set retarder additive. Any set retarders employed should be limited to those amounts required to provide time enough to safely conduct cement placement operations. In this context, such a time would be that time required to place the cement without the onset of hardening and which would permit the flow of cement from the conduit into the borehole.

As mentioned earlier, cement slurries useful herein may contain fluid loss control additives and formation compatibility additives as are well known in the prior art.

The following example is provided to indicate a preferred embodiment of this invention; however, the example should not be used to duly limit the scope of any claimed embodiment.

EXAMPLE

A kickoff plug was determined to be required in a borehole which was cased with $7\frac{5}{8}$ inch casing to a depth of about 8,235 feet. The plug was to be set at a depth between 6,950 feet and 7,080 feet below the top of the borehole. A portion of the $7\frac{5}{8}$ inch casing was removed between the depth of 6,950 feet and 7,050 feet. Thereafter, the uncased portion of the borehole was enlarged to a diameter of about 10 inches. Accordingly, about 100 feet of a 10 inch diameter kickoff plug was to be set between the depths of 6,950 feet and 7,050 feet and about 30 feet of a plug having a diameter of about 6,765 inches was to be set between 7,050 feet and 7,080 feet.

The borehole, which was filled with drilling fluid containing drill cuttings, was circulated for about two hours to remove the cuttings and to adjust the yield point of the drilling fluid to a value of about 13 pounds per 100 square feet. The drill string was then removed from the wellbore and the bottom 130 feet of drill pipe was removed from the string. Thereafter, the drill string was introduced into the wellbore by first introducing a diverter sub, followed by 130 feet of $2\frac{7}{8}$ inch tubing and thereafter by the original drill pipe. The diverter tool used, as described above, was a short length of tubing of circular cross section having eight 0.5 inch diameter holes drilled in the wall thereof. The eight holes were divided between two parallel tiers of holes each having four holes. Each hole in each tier was separated by 90° and the holes in adjacent tiers were offset by 45°.

The diverter tool, attached to the 130 feet of $2\frac{7}{8}$ inch tubing, was lowered to the planned top of cement at 6,950 feet and at that point circulation was established by injecting drilling fluid into the drill string and out through the holes in the diverter tool at a rate of about five barrels per minute. Circulation was continued while the drill string was lowered from 6,950 feet to 7,080 feet. At 7,080 feet lowering of the drill string was terminated and two complete bottoms up circulation was performed to complete conditioning of the wellbore and to render the drilling fluid satisfactory for cementing.

From the circulation rate, pipe sizes and hole diameters provided, it was calculated that the linear velocity in the $2\frac{7}{8}$ inch tubing was about 864 feet per minute, the linear velocity through each of the eight holes in the diverter tool was about 2,573 feet per minute, the linear velocity in the annulus of the cased portion of the hole was about 137 feet per minute and the linear velocity in the annulus of the uncased portion of the hole was about 56 feet per minute.

Upon completion of circulation, 50 barrels of seawater were pumped into the drill string at five barrels per minute, thereafter, 54 barrels of cement slurry having a density of 16.8 pounds per gallon and containing 300 sacks of Class H cement and no additives was pumped at a rate of five barrels per minute followed by five barrels of seawater at five barrels per minute. Thereafter, 31 barrels of the same drilling mud utilized to drill the borehole was pumped at a rate of five barrels per minute. Upon setting of the balanced plug, the drill string was slowly pulled from the balanced column at a rate of about 90 feet every four minutes until the diverter tool was completely clear of the top of the cement. This was a rate of pull of about $22\frac{1}{2}$ feet per minute. Thereafter, the drill string was pulled up about 1,000 feet above the top of the cement.

The plug was allowed to set for at least 24 hours. Thereafter, an attempt was made to divert the drilling direction. The attempt was successful.

Having thus described the invention, that which is claimed is:

1. A method of conditioning a borehole penetrating a subterranean formation from the earth's surface prior to the cementing thereof, said method comprising the steps of:

identifying the locations in said borehole where the intended top of cement (TOC) and where the intended bottom of cement (BOC) shall be;

introducing a conduit into said borehole and positioning the bottom of said conduit at said TOC;

injecting at least two streams of drilling fluid from said conduit into said borehole at said TOC wherein said streams of said drilling fluid are injected at high velocity from said bottom of said conduit in at least one plane wherein said plane is substantially parallel to the cross section of said borehole, whereby said streams impact the walls of said borehole in said at least one plane;

continuing said injecting of said streams and establishing circulation of said drilling fluid from the bottom of said conduit to the top of said borehole by way of the annular space between said conduit and the walls of said borehole;

moving said conduit, while continuing said circulation, from TOC to a termination location which is at least the location of said BOC;

continuing said circulation from said termination location;

discontinuing said circulation of said drilling fluid when the properties of said drilling fluid are desirable for cementing and when at least one volume of drilling fluid equivalent to the annular volume between the conduit and the borehole wall from the surface to said termination location has been circulated from said termination location to the surface of said borehole whereby said conditioning of said borehole is completed.

2. The method of claim 1 wherein the linear velocity of said drilling fluid in said annular space during said circulation is in the range of from about 40 to about 300 feet per minute and the circulation rate of said drilling fluid is in the range of from about 3 to about 25 barrels per minute.

3. The method of claim 2 wherein said conduit is rotated and/or reciprocated during said moving of said conduit from TOC to said termination location.

4. The method of claim 3 wherein said high velocity streams of said drilling fluid impact said walls of said borehole at an acute angle to said walls of said borehole and said streams are caused to flow in the same rotational direction whereby a swirling motion is produced in said circulating drilling fluid.

5. The method of claim 4 wherein eight of said high velocity streams are injected in two of said planes, wherein said planes are adjacent, spaced apart and substantially parallel to the cross section of said borehole.

6. The method of claim 5 wherein four of said high velocity streams are included in each of said two adjacent planes and wherein said streams in each of said planes are spaced about 90° apart.

7. The method of claim 6 wherein the streams in one of said planes are offset from the streams in the adjacent plane by an amount of about 45°.

8. The method of claim 7 wherein the linear velocity of each of said injected streams is substantially equal to the linear velocity of every other of said streams.

9. A method of forming a kickoff plug in a borehole, said method comprising preparing said borehole for cementing in a first phase and placing hydraulic cement in said borehole in a second phase;

said first phase is comprised of the steps of:

identifying the interval in said borehole where said kickoff plug is to be formed, removing gelled mud and mud cake from the walls of said borehole in said interval and preparing drilling fluid for cementing operations;

wherein the top of cement (TOC) is at the upper end of said interval, the bottom of cement (BOC) is at the lower end of said interval and said removing and preparing steps comprise injecting at least two streams of said drilling fluid into said borehole at said TOC wherein said streams of said drilling fluid are injected at high velocity from the bottom of a conduit disposed in said borehole in at least one plane wherein said plane is substantially parallel to the cross section of said borehole, whereby said streams impact the walls of said borehole in said at least one plane, continuing said injecting of said streams and establishing circulation of said drilling fluid from the bottom of said conduit to the top of said borehole by way of the annular space between said conduit and the walls of said borehole, and moving said conduit, while continuing said circulation, from TOC to a termination location which is at least the location of said BOC;

said second phase is comprised of the steps of;

positioning the bottom of said conduit at said BOC, placing a balanced plug of a slurry of hydraulic cement in water in said interval comprising, introducing said slurry into said annular space from the bottom of said conduit at BOC until the level of said slurry in said annular space and in said conduit are the same;

wherein said slurry is introduced by injecting at least two streams of said slurry at high velocity in at least one plane wherein said plane is substantially parallel to the cross section of said borehole;

withdrawing said conduit from said borehole at a controlled rate until the bottom of said conduit is at least above TOC;

wherein said controlled rate is the smaller of the rate at which said slurry in said annular space and in said conduit flow into the volume created by the withdrawal of said conduit or at a rate which will minimize mixing of said slurry and drilling fluid caused by said withdrawal;

and then permitting said slurry to set to thereby form said kickoff plug.

10. The method of claim 9 wherein the linear velocity of fluid in said annular space during said circulation is in the range of from about 40 to about 300 feet per minute and the circulation rate of said fluid is in the range of from about 3 to about 25 barrels per minute.

11. The method of claim 10 wherein said high velocity streams of said fluid impact said walls of said borehole at an acute angle to said walls of said borehole and said streams are caused to flow in the same rotational direction whereby a swirling motion is produced in said circulating drilling fluid.

12. The method of claim 11 wherein eight of said high velocity streams are injected in two of said planes, wherein said planes are adjacent, spaced apart and substantially parallel to the cross section of said borehole.

13. The method of claim 12 wherein four of said high velocity streams are included in each of said two adjacent planes and wherein said streams in each of said planes are spaced about 90° apart.

14. The method of claim 13 wherein the streams in one of said planes are offset from the streams in the adjacent plane by an amount of about 45°.

15. The method of claim 11 wherein said slurry of hydraulic cement is stable and has a gel strength in the range of from about 10 to about 80 pounds per 100 square feet.

16. The method of claim 15 wherein the density of said slurry is not greater than about 0.5 pounds per gallon more than the density of said drilling fluid and wherein the thickening time of said slurry is equal to placement time thereof plus an additional time in the range of from about 0.5 to 1 hour based on expected circulating temperature in said interval.

17. The method of claim 16 wherein eight of said high velocity streams are injected in two of said planes, wherein said planes are adjacent, spaced apart and substantially parallel to the cross section of said borehole.

18. The method of claim 17 wherein four of said high velocity streams are included in each of said two adjacent planes and wherein said streams in each of said planes are spaced about 90° apart.

19. The method of claim 18 wherein the streams in one of said planes are offset from the streams in the adjacent plane by an amount of about 45°.

20. The method of claim 19 wherein the linear velocity of each of said injected streams is substantially equal to the linear velocity of every other of said streams.

* * * * *

UNITED STATES PATENT AND TRADEMARK OFFICE

CERTIFICATE OF CORRECTION

PATENT NO. : 5,368,103

DATED : November 29, 1994

INVENTOR(S) : James F. Heathman, et. al.

It is certified that error appears in the above-identified patent and that said Letters Patent is hereby corrected as shown below:

Title page, item [73], Assignee: after "Halliburton Company, Duncan, Okla." insert--Atlantic Richfield Company, Plano, Texas--.

Signed and Sealed this

Tenth Day of February, 1998

*Attest:*

*Attesting Officer*

BRUCE LEHMAN

*Commissioner of Patents and Trademarks*